US006312081B1

(12) United States Patent
Ohtsu

(10) Patent No.: US 6,312,081 B1
(45) Date of Patent: Nov. 6, 2001

(54) INK JET RECORDING METHOD

(75) Inventor: Kazuhiko Ohtsu, Numazu (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/458,214

(22) Filed: Dec. 9, 1999

(30) Foreign Application Priority Data

Dec. 10, 1998 (JP) ..... 10-351324
Sep. 9, 1999 (JP) ..... 11-255888

(51) Int. Cl.[7] ..... B41J 2/205

(52) U.S. Cl. ..... 347/15; 347/43; 347/16; 347/105; 347/100

(58) Field of Search ..... 347/15, 43, 16, 347/6, 95, 100, 105, 106, 96

(56) References Cited

U.S. PATENT DOCUMENTS

| | | | | |
|---|---|---|---|---|
| 5,459,502 | | 10/1995 | Sakaki et al. | 347/100 |
| 5,561,454 | * | 10/1996 | Kurabayashi et al. | 347/105 |
| 5,608,438 | * | 3/1997 | Koike et al. | 347/100 |
| 5,805,190 | | 9/1998 | Tsuchii et al. | 347/100 |

FOREIGN PATENT DOCUMENTS

| | | |
|---|---|---|
| 7-47762 | 2/1995 | (JP) . |
| 7-156537 | 6/1995 | (JP) . |
| 8-281934 | 10/1996 | (JP) . |
| 10-316915 | 12/1998 | (JP) . |

* cited by examiner

*Primary Examiner*—N. Le
*Assistant Examiner*—Lamson D. Nguyen
(74) *Attorney, Agent, or Firm*—Frishauf, Holtz, Goodman, Langer & Chick, P.C.

(57) ABSTRACT

Time T (ms) required for an ink droplet ejected onto a recording medium to be absorbed completely by the recording medium is represented by: $T=(4V/\pi D^2Ka)^2$, where V represents a maximum amount (ml) of the ink droplet ejected from the recording head in a single operation, D represents an average diameter (m) of an equivalent circular area of the dot when the ink droplet impinges on the recording medium, and Ka represents an ink absorption coefficient ($ml/m^2 \cdot ms^{1/2}$) of the recording medium. The conditions of T, V, D and Ka are set to meet the relationship $T \leqq Tx$ (ms), where Tx represents the time between a step for a first ink droplet to impinge on a certain position of the recording medium and another step for a second ink droplet to impinge on the same position of the recording medium. In other words, T, V, D and Ka are set to meet the relationship: $4V/\pi D^2Ka)^2 < Tx$.

4 Claims, 4 Drawing Sheets

INK JET RECORDING METHOD

BACKGROUND OF THE INVENTION

The present invention relates to an ink jet recording method for recording an image on a recording medium by using an ink jet recording head.

In an ink jet recording system, an ejection energy generator such as a piezoelectric element or an electric heat converting element, etc. is used as an ejection driving source, and an ink housed in an ink chamber is ejected through ink ejecting orifices made in an orifice plate arranged within the ink chamber so as to allow the ejected ink to be attached to a recording medium such as a recording paper sheet or a film. The ink attached to the recording medium is absorbed by and fixed to the recording medium so as to perform the image recording. In general, a nonvolatile and highly hygroscopic solvent, i.e., a nonvolatile wetting agent, is added to the ink used in such a recording system to make the ink unlikely to be dried so as to prevent the ink in the ink ejecting orifice from being dried and from bringing about plugging of the ink ejecting orifice. The ink having a wetting agent added thereto is certainly effective for preventing the plugging of the ink ejecting orifice. However, the ink ejected onto the recording medium is unlikely to be dried promptly.

In performing an image recording such as a full color image recording in an ink jet recording system, a special recording paper sheet is used in many cases in order to allow the ink to be attached to, absorbed by and fixed to the recording medium satisfactorily. To be more specific, the special recording paper sheet is prepared by coating the surface of a mother material of an original paper sheet with a dispersion prepared by dispersing pigments such as $SiO_2$. CaO or an organic material in a hydrophilic binder. However, the special recording paper sheet of this type is costly, making it difficult to use the special recording paper sheets freely.

In general, ordinary paper sheets or high quality paper sheets are widely used as the ink jet recording paper sheet. However, these paper sheets are not satisfactory in the capability of absorbing the ink, with the result that problems given below take place in the case of applying an image recording to the ordinary paper sheets or high quality paper sheets that are widely used in general.

Specifically, if an image recording is performed by using an ink relatively satisfactory in image quality of the characters and line images and low in drying speed, it is possible for the ink droplets recorded on the recording medium to be present on or inside the paper sheet under the state that the ink droplets are not sufficiently dried and fixed. In this case, the ink droplets are not dried promptly, with the result that the coloring matter such as a dye or a pigment within the ink droplets is fluidized and diffused so as to cause the ink droplets positioned contiguous to each other or superposed one upon the other to be mixed with each other. It follows that a color blurring called bleed is generated between adjacent ink droplets of different colors so as to deteriorate the image quality.

It may be possible to suppress the color blurring problem between different colors in a full color image by using as the recording medium ordinary paper sheets or high quality paper sheets that are not satisfactory in the ink absorption capability and by using an ink that is relatively high in drying capability and permeability. In this case, however, the ink droplets promptly permeate deep into the recording medium and, thus, the coloring matter does not remain on the surface of the paper sheet. As a result, the printing region of the ink droplets is caused to have a low density, leading to a narrow range of the color reproducibility. In addition, since the ink is diffused toward the surface of the recording medium so as to be dried, the line tends to be thickened and the image quality is greatly deteriorated by the feathering.

The ink jet recording method disclosed in, for example, Japanese Patent Disclosure (Kokai) No. 7-47762, is known to overcome the problems pointed out above. Specifically, disclosed in this prior art is an ink jet recording apparatus provided with a plurality of recording heads for ejecting ink droplets differing from each other and using an aqueous ink having a water-soluble dye dissolved therein. It is taught that the recording is performed by using a black ink and color inks, i.e., inks of yellow, magenta and cyan in general, in combination. The black ink is specified to have an absorption coefficient Ka in the recording medium, i.e., an ink absorption coefficient determined by Bristol method, of 0.5 ($ml/m^2 \cdot ms^{1/2}$) or less and a wetting time Tw of 50 to 200 ms. On the other hand, each of the color inks is specified to have the absorption coefficient Ka in the recording medium of 1.0 ($ml/ m^2 \cdot ms^{1/2}$) or more and the wetting time Tw of 20 ms or less.

To be more specific, the printing is performed first by using an ink having the absorption coefficient Ka of 0.5 ($ml/m^2 \cdot ms^{1/2}$) or less and the wetting time of 50 to 200 ms. Then, after the minimum delay time Td determined by the absorption characteristics of the ink, the amount of the ink droplet, and the number of ink droplets per unit area, the printing is performed by using an ink having the absorption coefficient Ka of 1.0 ($ml/ m^2 \cdot ms^{1/2}$) or more and the wetting time Tw of 20 ms or less. It is taught that the particular printing technique makes it possible to achieve printing of sharp characters and line images and to suppress the color blurring on the ordinary paper sheet that is a recording medium low in the ink absorption rate.

However, it is difficult to determine the optimum printing conditions by simply referring to the absorption coefficient Ka derived from the result of the Bristol method for measuring the ink permeability into the recording medium, the wetting time Tw, the coarseness index, the specification of the printer, the printed pattern image, etc. In order to determine the compatibility and compatible conditions between the ink and the recording medium, it is necessary to evaluate the ink permeability into the recording medium by the Bristol method, to evaluate the printed state by using an evaluating tester, and to evaluate the printing test by a machine manufactured on the trial basis in all the combinations. It follows that much time and labor are required, leading to an inefficient determination of the compatibility and compatible conditions between the ink and the recording medium.

It should also be noted that, if the absorption coefficient Ka is small in the case of operating the printer at a high printing speed, the fixation is rendered unsatisfactory. Therefore, where colors of, for example, yellow, magenta and cyan are superposed one upon the other in the order mentioned in performing a color image recording, it is possible for the magenta ink droplets to cover the yellow ink droplets ejected first while the yellow ink droplets are in the process of permeating the recording medium so as to bring about the bleeding problem. It is also possible for the next ink droplets to be ejected before the previous ink droplets are fixed. Also, if the absorption coefficient is unduly large, color blurring is brought about in general. Particularly, the feathering, which is a blurring of a single color, tends to become excessively prominent.

It should also be noted that, if magenta ink droplets are ejected onto the adjacent dot positions while the yellow ink droplets ejected previously are in the process of permeating the recording medium, the magenta ink droplets are brought into contact with the yellow ink droplets so as to bring about the bleeding problem. Also, the dot image is rendered large so as to impair the resolution of the printed image. The bleeding does not take place in the monochromatic printing. However, a problem remains unsolved that the printed dot is enlarged by the bleeding.

What should also be noted is that it is necessary to prepare at least two kinds of inks differing from each other in properties for a single printer, giving rise to the problems that it is troublesome to prepare the solvents and that the ink cost is increased. Further, if the properties of the ink are changed, it is unavoidable to change the compatibility of the ink to the head, making it necessary to change the driving conditions for ejecting inks having different properties from the head. In the worst case, it is necessary to change the construction of the head.

BRIEF SUMMARY OF THE INVENTION

An object of the present invention is to provide an ink jet recording method, which permits prominently suppressing deterioration of the image quality such as thickening of the lines and characters, color blurring, etc., which permits improving the fixing properties and lowering the ink cost, and which permits determining efficiently the compatible conditions from the dot diameter, the amount of the ink droplet, the optimum conditions of the printing speed, etc. and from the results of permeability when the ink permeates the recording medium.

According to an aspect of the present invention, there is provided an ink jet recording method for recording an image on a recording medium by using an ink jet recording head, comprising the step of performing an image recording by setting time T (ms) required for an ink droplet ejected onto a recording medium to be absorbed completely by the recording medium, a maximum amount V (ml) of the ink droplet ejected from the recording head in a single operation, an average diameter D (m) of an equivalent circular area of the dot when the ink droplet impinges on the recording medium, and an ink absorption coefficient Ka ($ml/m^2 \cdot ms^{1/2}$) of the recording medium obtained by the Bristol method, the T, V, D and Ka having the relationship "$T=(4V/\pi D^2 Ka)^2$", to meet the condition of $T \leqq Tx$ (ms), Tx representing the time between a step for a first ink droplet to impinge on a certain position of the recording medium and another step for a second ink droplet to impinge on the same position of the recording medium.

The particular technique of the present invention makes it possible to prominently suppress deterioration of the image quality such as thickening of the lines and characters and the color blurring, to improve the fixing properties, and to reduce the ink cost. In addition, the compatible conditions can be determined efficiently from the optimum conditions such as the dot diameter and the amount of the ink droplet and from the permeability of the ink into the recording medium.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention

DETAILED DESCRIPTION OF THE INVENTION

One embodiment of the present invention will now be described with reference to the accompanying drawings.

Figure 1:
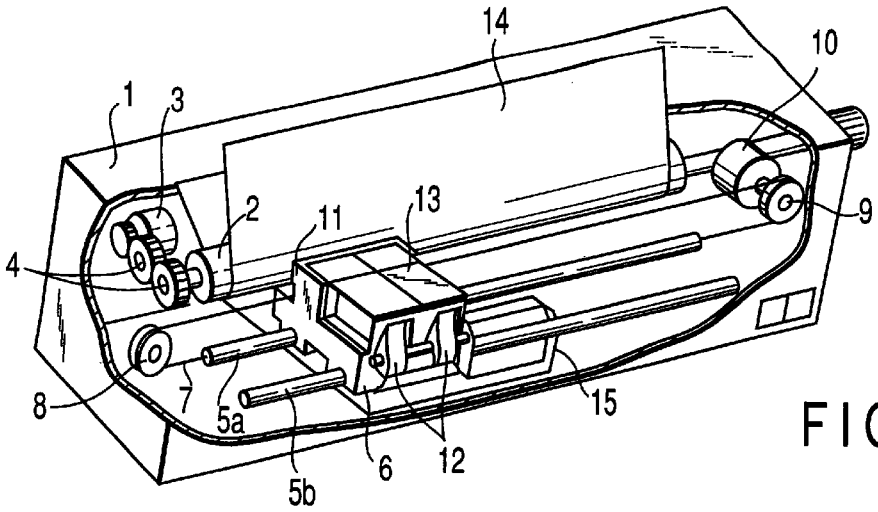
FIG. 1 is an oblique view, partly broken away, showing an ink jet recording apparatus used in the method of the present invention.

Specifically, FIG. 1 is an oblique view, partly broken away, showing an ink jet printer used in the method of the present invention. As shown in the drawing, a platen 2, which can be rotated by a platen driving motor 3 via a gear mechanism 4, is housed within a case 1. Two guide shafts 5*a*, 5*b* are arranged in parallel along the platen 2.

A base 6 is slidably mounted to these guide shafts 5*a*, 5*b*. An endless belt 6, which is mounted to the base 6, is stretched between a driven pulley 8 and a driving pulley 9. The driving pulley 9 is rotated by a driving motor 10. It follows that the driving pulley 9 is rotated by the rotation of the driving motor 10 so as to permit the endless belt 7 to rotate around the pulleys 8 and 9. As a result, the base 6 is moved back and forth along the platen 2.

An ink jet head 11 is fixed by a hook 12 to the base 6, and an ink tank 13 is arranged behind the head 11. An ink is supplied from the ink tank 13 to the head 11.

A printing paper sheet 14 used as a recording medium is wound about the platen 2. The printing paper sheet 14 is inserted into the case 1 from behind the case 1, wound about the platen 2 and, then, discharged to the outside of the case 1 from a front portion of the case 1. A reference numeral 15 denotes a cable for transmitting printing data and signals to the head driving section.

In the printer of the particular construction, the driving motor 10 is rotated under the condition that the recording paper sheet 14 is wound about the platen 2. Also, the head driving section drives the head 11 on the basis of the printing data. As a result, the head 11 is moved back and forth along the platen 2, and ink droplets are ejected from the head 11 onto the recording paper sheet 14 so as to carry out the required printing.

The present inventors have conducted an experiment by using oil pigment inks prepared by dispersing pigments in a petroleum-based solvent to see whether it is possible to obtain color images low in color blurring and forming sharp characters and lines, covering the case where color images are printed with the ink jet printer of the construction described above by using coated paper sheets (exclusive paper sheets) available on the market as paper sheets for the ink jet printing and ordinary paper sheets such as PPC. In this experiment, the permeability of the ink into the recording medium was tested by the Bristol method in an attempt to determine based on the relationship between the resultant data and the degree of blurring on the color images the conditions under which color images low in color blurring and forming sharp characters and lines can be obtained by the printing at a high speed.

In the first step, prepared were oil pigment inks prepared by dispersing pigments in a petroleum-based solvent and 20 kinds of coated paper sheets available on the market and selected at random and ordinary paper sheets such as PPC. Used in this experiment were oil inks having a negligibly short wetting time in the testing by the Bristol method. However, it is also possible to use an aqueous ink in place of the oil ink as far as the wetting time is negligibly short.

In the next step, the permeability of the ink into the paper sheet is tested by the Bristol method by using the inks and 20 kinds of the recording media so as to obtain the absorption coefficient Ka. The absorption coefficient Ka represents a value measured by "J. TAPPI Paper Pulp Testing Method No. 51–87, 'Liquid Absorption Testing Method for Paper and Board'", which is a standard specified by Paper and Pulp Technology Association, i.e., measured by the Bristol method.

Figure 2:
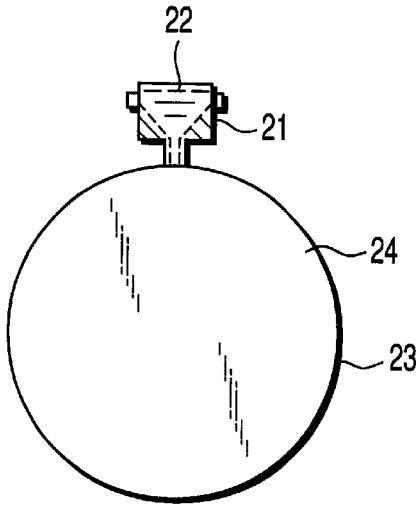
FIG. 2 is for explaining the measuring principle by the Bristol method.

FIG. 2 shows how to determine the amount of the ink transfer into a paper sheet. Specifically, a predetermined amount of an ink 22 is put in a head box 21 to permit the ink 22 to be transferred into the paper sheet 24 pasted to the outer circumferential surface of a rotatable drum 23. The transfer amount of the ink 22 into the paper sheet 24 can be measured, with the contact time between the ink 22 and the paper sheet 24 controlled to fall within a range of between 0.004 and 2.0 seconds by changing the rotating speed of the drum 23.

Figure 3A:
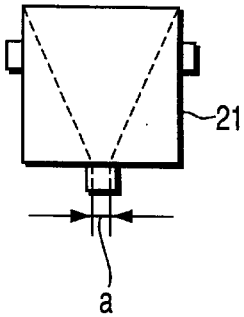
FIGS. 3A to 3C collectively show the construction of a head box for the measurement by the Bristol method shown in FIG. 2.
Figure 3B:
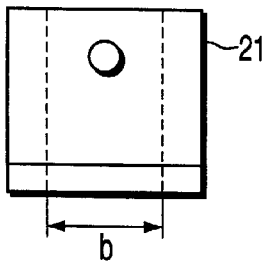
Figure 3C:
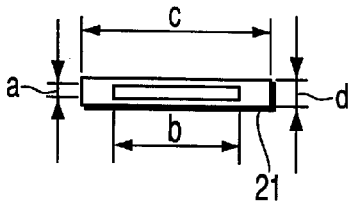

The head box 21 is constructed as shown in FIGS. 3A, 3B and 3C. Specifically, FIG. 3A is a front view, FIG. 3B is a side view, and FIG. 3C is a bottom view of the head box 21. As shown in the drawings, the head box 21 has a slit formed in a bottom portion that is brought into contact with the paper sheet 24. The slit has a width of 1.0 mm, and a length b of 15.0 mm. On the other hand, the entire bottom has a length c of 17.8 mm and a width d of 3.2 mm.

Figure 4:
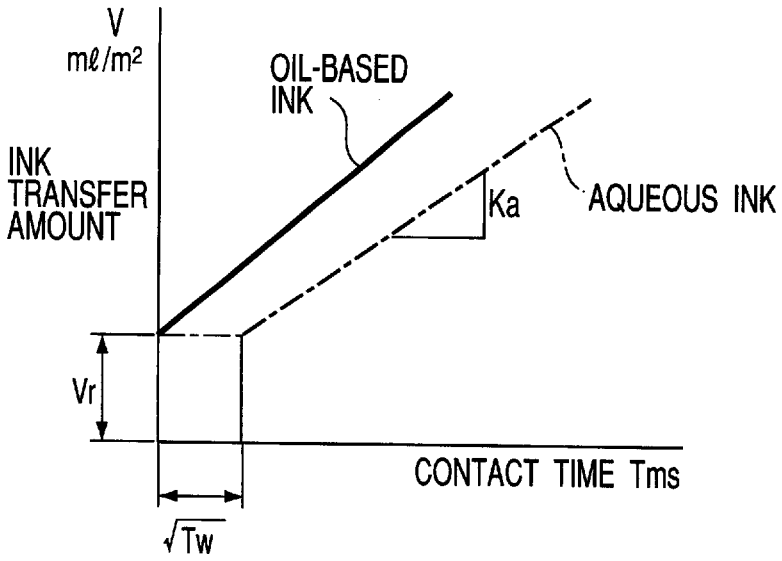
FIG. 4 is a graph showing the results of measurements of an oil ink and an aqueous ink by the Bristol method.

FIG. 4 is a graph showing the relationship between the contact time and the ink transfer amount in respect of the oil-based ink and the aqueous ink. The contact time is plotted on the abscissa of the graph with a scale of a square root of the time. The inclination of the graph represents the absorption coefficient Ka. Also, the ink transfer amount at the contact time 0 (ms) is called a coarse index Vr, which represents the mount of the ink entering the irregular surface of the paper sheet. It should be noted that the ink absorption does not take place at the initial period of the contact, which is called a wetting time Tw of the ink. In other words, the paper sheet 24 is wetted by the ink 22 in the wetting time Tw.

In general, the oil-based ink does not have a wetting time and the aqueous ink has a wetting time, as shown in the graph. The graph is represented by:

$$V=Vr+Ka(T-Tw)^{1/2}$$

where, V is the ink transfer amount, Vr is the coarse index, Ka is the absorption coefficient, T is the absorption time, and Tw is the wetting time.

The ink absorption coefficient Ka is determined by the surface state of the paper sheet, the properties of the ink, and the wettability between the ink and the paper sheet. The ink permeation rate is determined by the value of Ka such that a large value of Ka represents a high permeation rate, with a small value representing a low permeation rate. In other words, the absorption rate is determined by the ink absorption coefficient Ka alone.

In the next step, a bleeding test was conducted by using the 20 kinds of the recording media that have been tested. Specifically, dot images for looking into the bleeding were printed with the ink jet printer shown in FIG. 1, and the dot images were measured by an image evaluation apparatus of a dot analyzer manufactured by Oji Keisoku Kiki K. K. so as to obtain a circularity coefficient. The measurement was applied to 24 dots, and the measured values were averaged. The circularity coefficient thus obtained was used for determining the degree of bleeding.

The circularity coefficient, which is based on the area and circumferential length of the dot, is represented by "$4\pi\times$ dot area/(circumferential length of dot)$^2$. Where the dot is completely circular, the circularity coefficient is 1, and the circularity coefficient is made smaller with increase in the degree of deformation of the dot from the completely circular state. The small circularity coefficient denotes that the dot is greatly deformed by bleeding. To be more specific, the circularity coefficient not smaller than 0.7 denotes that the bleeding is very small. The circularity coefficient not smaller than 0.5 denotes that the bleeding is also small. However, the circularity coefficient of 0.5 denotes the highest level of deformation of the dot. The term "bleeding" used herein represents a so-called "feathering", which is a bleeding of a single color.

Figure 5:
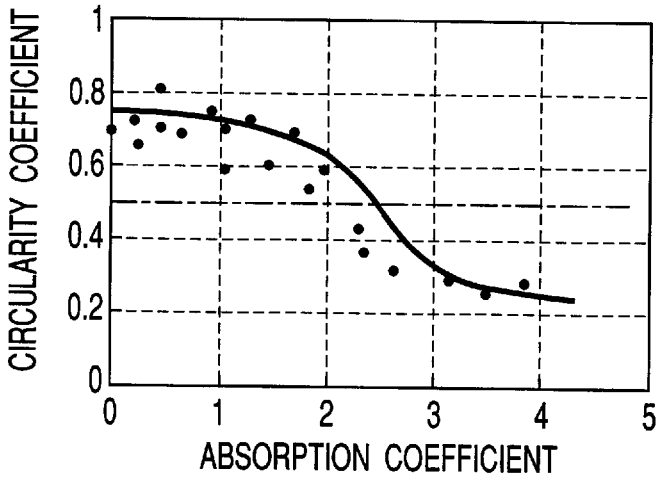
FIG. 5 is a graph showing the relationship between the absorption coefficient of the recording paper sheet tested in the embodiment of the present invention and the circularity coefficient.

The relationship between the absorption coefficient Ka of the 20 kinds of the recording media tested and the circularity coefficient is shown in Table 1 and in a graph of FIG. 5.

TABLE 1

| No. | Manufacturers | Kind | Absorption coefficient | Circularity coefficient |
|---|---|---|---|---|
| 1 | EPSON | fine | 1.06 | 0.581 |
| 2 | EPSON | super fine | 0.22 | 0.664 |
| 3 | CANON | high grade exclusive paper sheet | 0.41 | 0.814 |
| 4 | KAO | high grade | 1.04 | 0.708 |

TABLE 1-continued

| No. | Manufacturers | Kind | Absorption coefficient | Circularity coefficient |
|---|---|---|---|---|
| 5 | KOKUYO | high grade | 0.01 | 0.692 |
| 6 | HP | premium ink jet paper | 0.18 | 0.714 |
| 7 | HITACHI MAXEL | standard | 1.97 | 0.593 |
| 8 | Xerox | 4024 | 2.65 | 0.324 |
| 9 | TOSHIBA | PPC Paper | 3.15 | 0.314 |
| 10 | HAMMERMILL | Tidal-Dp | 2.36 | 0.377 |
| 11 | UNION CAMP | COATED PAPER | 1.44 | 0.601 |
| 12 | CHAMPION | INK JET PAPER | 0.43 | 0.701 |
| 13 | BOISE CASCADE | COATED INK JET PAPER | 1.67 | 0.681 |
| 14 | Zeiegler | z-plot 650 | 1.86 | 0.548 |
| 15 | FAIRFIELD | HD17O | 0.63 | 0.689 |
| 16 | Corimex | INK-JET PAPER | 0.91 | 0.737 |
| 17 | XEROGRAPHIC | Butler Paper | 3.5 | 0.289 |
| 18 | HAMMERMILL | unity Dp | 3.86 | 0.302 |
| 19 | Folex | PREMIUM INK JET PAPER | 1.27 | 0.728 |
| 20 | Hammermill | Premium Ink Jet Paper | 2.3 | 0.445 |

The graph of FIG. 5 shows that the circularity coefficient is larger than 0.5, which provides the criterion for determining whether the bleeding is satisfactory or not, where the absorption coefficient is smaller than 2.5. In other words, the feathering is increased if the ink absorption coefficient is 2.5 or more.

Then, a fixing test was conducted by using 20 kinds of recording media partly differing from those described previously. For the fixing test, a test pattern was prepared by printing a black solid image with the ink jet printer shown in FIG. 1. Then, the density on the surface of that portion of the recording medium in which the solid image of the test pattern was not formed was measured at three points by a densitometer, followed by allowing a new type NR-100 (trade name of a vibration type tester for fastness of rubbing of a dyed material manufactured by Daiei Kagaku Seiki Mfg. Co., Ltd.) to slide both ways 5 times along the ink coated image portion. The sliding was controlled to permit the sliding member sliding along the ink coated image to slide simultaneously and without fail along that surface of the recording medium which was not coated with the ink. For the sliding test, the moving speed was set at 12 cm/sec, the weight load was set at 500 g, and a "PPC Pad " manufactured by Toshiba Corporation was used as the sliding member.

After the sliding, the density on that surface of the recording medium along which the sliding member was allowed to slide, i.e., the density on the surface of the recording medium stained with the ink rubbed down from the surface of the ink coated imaged, was measured at three points.

In this experiment, the fixing capability was determined by the degree of stain of the non-printed white portion caused by the sliding of the ink on the black solid image. The degree of stain was determined by:

$$A=\{(B-C)/C\}\times 100$$

where A is the degree of stain, B is the density on the surface of the recording medium after the sliding, and C is the density on the surface of the recording medium before the sliding.

The higher degree of stain represents the poorer fixing capability. Incidentally, the fixing capability was determined in this experiment by the densities before and after the sliding. Alternatively, it is also possible to determine the fixing capability by a color difference ΔE measured by a color difference meter between the color before the sliding and the color after the sliding.

Figure 6:
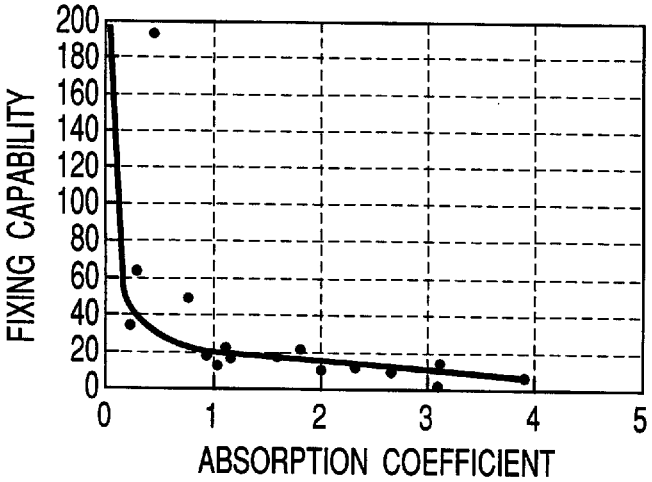
FIG. 6 is a graph showing the relationship between the absorption coefficient of the recording paper sheet tested in the embodiment of the present invention and the fixing properties.

The relationship between the absorption coefficient Ka of the 20 kinds of the recording media tested and the fixing capability is shown in Table 2 and in the graph of FIG. 6.

TABLE 2

| No. | Manufacturers | Kind | Absorption coefficient | Fixing capability |
|---|---|---|---|---|
| 1 | EPSON | fine | 1.06 | 12.5 |
| 2 | EPSON | super fine | 0.22 | 33.3 |
| 3 | CANNON | color BJ paper | 0.1 | 111 |
| 4 | CANNON | BJ paper | 0.28 | 64.3 |
| 5 | CANNON | high grade exclusive paper sheet | 0.41 | 195 |
| 6 | CANNON | color ordinary paper | 0.92 | 18.7 |
| 7 | KAO | standard | 1.85 | 22.2 |
| 8 | KAO | high grade | 1.04 | 42.9 |
| 9 | KAO | super high grade | 1.06 | 12.5 |
| 10 | KOKUYO | hiqh grade | 0.01 | 81.1 |
| 11 | KOKUYO | ink jet printer paper sheet | 1.18 | 17.4 |
| 12 | Abel | ultra fine | 1.11 | 23 |
| 13 | SAFIR | IJP 90 beschichtet S | 0.75 | 50 |
| 14 | TOSHIBA | Copy Paper (red) | 2.72 | 11.1 |
| 15 | TOSHIBA | PPC Paper | 3.15 | 3.9 |
| 16 | XEROGRAPHIC | Butler Paper | 3.86 | 8.7 |
| 17 | CANON | new printer paper | 1.64 | 16.7 |
| 18 | RIKOH | paper source | 3.16 | 16.7 |
| 19 | HAMMERMILL | HAMMERMILL PAPER | 2.36 | 12.5 |
| 20 | XEROX | P paper | 2.09 | 11.1 |

The graph of FIG. 6 shows that the fixing capability is greatly changed in a region where the absorption coefficient is 0.5 or less. In other words, it has been found that, where the absorption coefficient is 0.5 or less, the ink permeation into the recording medium is retarded, leading to a poor fixing capability even if the ink further permeates the recording medium.

Under the circumstances, in the case of printing a single color image, the optimum absorption coefficient Ka falls within a range of between 0.5 and 2.5 $ml/m^2 \cdot ms^{1/2}$.

In general, the absorption coefficient represents an ink permeation amount per unit time and per unit area, and the absorption coefficient Ka is determined by:

$$Ka=4V/\pi D^2 T^{1/2},$$

which can be transformed into:

$$T=(4V/\pi D^2 Ka)^2$$

where V represents a maximum amount (ml) of the ink droplet ejected from the ink jet head in a single operation, D represents an average diameter (m) of an equivalent circle of the dot formed by the ink droplet ejected onto the recording medium, and T represents the time (ms) required for the ink droplet to permeate entirely the recording medium.

In the present invention, it is absolutely necessary to meet the condition "$T \leqq Tx$", where Tx represents the time (ms) between a step for a first ink droplet to impinge on a certain position of the recording medium and another step for a second ink droplet to impinge on the same position of the recording medium. It should be noted in this connection that, if the second ink droplet impinges on the position on which the first ink droplet impinged previously after the first ink droplet permeated completely the recording medium, the printing quality can be improved. Particularly, it is possible to suppress the bleeding (feathering) or expansion of the dot image (enlargement of the dot diameter) so as to improve the resolution, if the second droplet impinges on the recording medium after the first droplet has permeated completely the recording medium.

Figure 7:
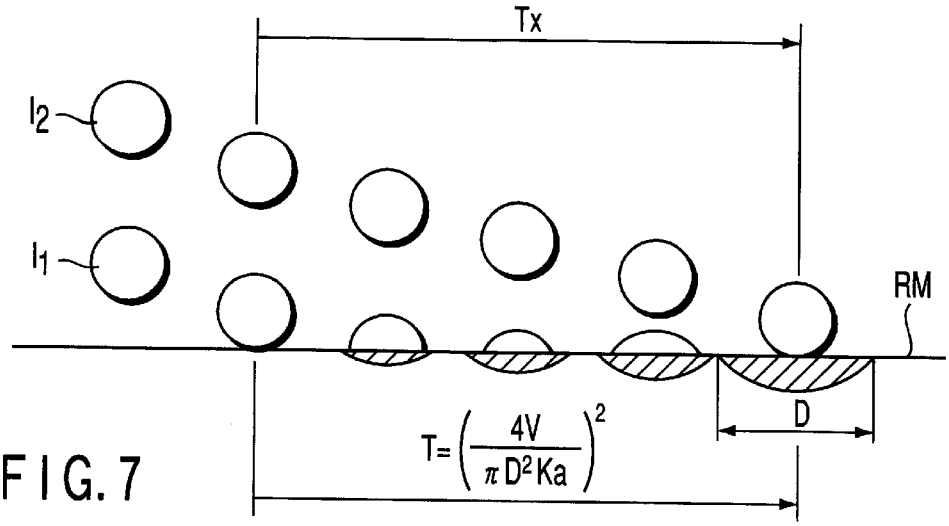
FIG. 7 shows an ink permeation model covering the case where ink droplets are allowed to impinge on the same positions i an overlapping fashion in the embodiment of the present invention.

For example, FIG. 7 shows an ink permeation model. In the drawing, time is plotted on the abscissa, and the moving direction of the ink droplet is plotted on the ordinate. Reference numeral $I_1$ in the drawing represents a first ink droplet impinging first on the recording medium RM, with reference numeral $I_2$ representing a second ink droplet impinging on the recording medium MR after the first ink droplet. In the example shown in FIG. 7, an optimum condition of T=Tx is satisfied, where $T=(4V/\pi D^2Ka)^2$, in which V is the amount of the ink droplet, D is the diameter of the equivalent circle of the dot image ejected onto the recording medium, and Ka is the absorption coefficient determined by "$Ka=4V/\pi D^2T^{1/2}$", and Tx represents the time defined above. In other words, if the second ink droplet $I_2$ is ejected onto the recording medium MR before the first ink droplet $I_1$ permeates completely the recording medium MR, the second ink droplet permeates the recording medium MR while expanding on the recording medium MR, with the result that the bleeding (feathering) is increased and the dot diameter is enlarged. It follows that it is impossible to achieve a high resolution.

For example, an experiment was conducted under predetermined conditions of Tx=40 (ms) and V=45 (pl) by using oil pigment ink prepared by dispersing a pigment in a petroleum-based solvent and 8 kinds of recording media having suitable absorption coefficient Ka and selected from the recording media given in Table 1 to obtain the results as shown in Table 3. Shown in Table 3 are the absorption coefficient Ka, the circularity coefficient during a single color printing, the dot diameter (diameter of the equivalent circle) D during a single color printing, the time $T=(4V/\pi D^2Ka)^2$ required for the ejected ink droplet to permeate completely the recording medium, and the evaluation of the color bleeding of the ink into the recording medium. The color bleeding was evaluated by "X" denoting a high bleeding, "○" denoting a low bleeding, and "Δ" denoting the bleeding intermediate between "X" and "○".

TABLE 3

| No. | Manufacturers | Kind | Ka | Circularity coefficient | D | T | Evaluation |
|---|---|---|---|---|---|---|---|
| 1 | HP | premium ink jet paper | 0.18 | 0.714 | 95.13 | 1237 | X |
| 2 | CHAMPION | INK JET PAPER | 0.43 | 0.701 | 93.66 | 230.7 | X |
| 3 | FAIRFIELD | HD 170 | 0.63 | 0.689 | 95.16 | 100.87 | X |
| 4 | Corimex | INK-JET PAPER | 0.91 | 0.737 | 100.72 | 38.52 | ○ |
| 5 | EPSON | FINE | 1.06 | 0.581 | 107.21 | 22.16 | ○ |
| 6 | Folex | PREMIUM INK JET PAPER | 1.27 | 0.728 | 78.45 | 53.74 | Δ |
| 7 | UNION CAMP | COATED PAPER | 1.44 | 0.601 | 124.9 | 6.505 | ○ |
| 8 | Zeiegler | z-plot 650 | 1.86 | 0.548 | 159.81 | 1.455 | ○ |

The relationship among the absorption coefficient Ka, the circularity coefficient and the dot diameter D is changed by the combination of the ink and the recording medium in various fashions in terms of the degree of the permeation, the depth of the permeation, and the degree of expansion in the surface of the recording medium. In other words, it is very difficult to evaluate the bleeding because there is no reliable rule for evaluating the bleeding. However, the experimental data support that the bleeding can be suppressed if the time T and the time Tx are set to meet the condition $T \leqq Tx$.

As described above, where V (ml) represents a maximum amount of the ink droplet ejected from the recording head in a single operation, D (m) represents an average diameter of an equivalent circular area of the dot when the ink droplet impinges on the recording medium, and Ka ($m/m^2 \cdot ms^{1/2}$) represents an ink absorption coefficient of the recording medium, T (ms), which represents time required for an ink droplet ejected onto a recording medium to be absorbed completely by the recording medium, is $T=(4V/\pi D^2Ka)^2$. If T, V, D and Ka are set to meet the condition of T<Tx (ms), i.e., $(4V/\pi D^2Ka)^2 \leqq Tx$, Tx representing the time between a step for a first ink droplet to impinge on a certain position of the recording medium and another step for a second ink droplet to impinge on the same position of the recording medium, it is possible to prominently suppress deterioration of the image quality caused by thickening of the lines and characters and the bleeding of the image. It is also possible to improve the fixing capability. Further, if the absorption coefficient Ka is set to fall within a range of between 0.5 and 2.5 $ml/m^2 \cdot ms^{1/2}$, deterioration of the image quality caused by the bleeding of the image and the fixing capability can be further improved, leading to a further improvement of the image quality.

Also, measures for deriving the optimum conditions can be obtained from the optimum conditions for the resolution (dot diameter), the amount of the ink droplet, the printing speed, etc. for performing the printing and from the result of permeability when the ink permeates the recording medium, making it possible to save the time and labor required for obtaining the measures for deriving the optimum conditions. In other words, these conditions can be derived efficiently.

Figure 8:
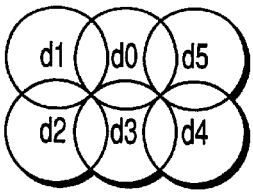
FIG. 8 shows the construction of the recorded images of adjacent dots.

The following description covers the case where ink droplets of different colors are ejected onto adjacent dot positions. Specifically, in an ink jet recording image, a certain dot d0 and adjacent dots d1 to d5 are set to overlap each other at least partially to eliminate a clearance among these dots, as shown in FIG. 8. Where the printing is performed to meet this condition, it is necessary to determine appropriately the timings of ejecting the first and second ink droplets onto the recording medium as in the superposed printing described previously.

Figure 9:
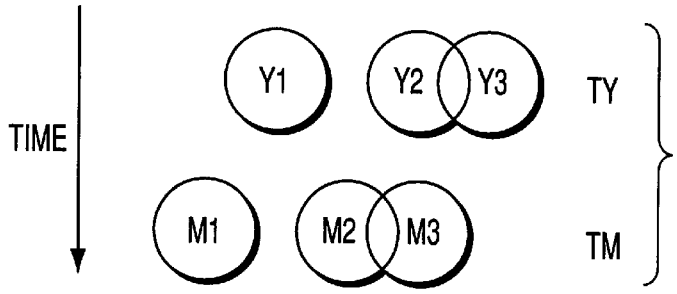
FIG. 9 shows the printing timing of adjacent dot images of different colors.

Suppose, for example, dots Y1, Y2, Y3 are printed first by a yellow ink at a timing TY, followed by printing dots M1, M2, M3 by a magenta ink at a timing TM, as shown in FIG. 9. In the drawing, the time denoting the print timing is plotted on the ordinate.

FIG. 9 shows that the magenta dot M1 is printed on the left side of the yellow dot Y1. The magenta dot M2 is printed intermediate between the yellow dots Y1 and Y2. Further, the magenta dot M3 is superposed on the yellow dot Y2. In this case, if the magenta dot M2 is ejected onto the recording medium before the yellow dot Y2 permeates the recording medium completely, a color bleeding phenomenon takes place.

Figure 10A:
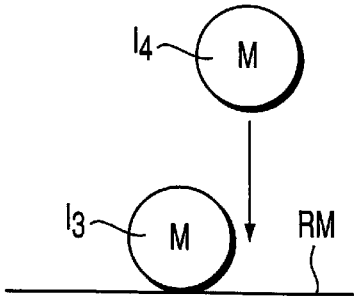
FIGS. 10A to 10E show the ink permeation model covering the/case where a color blurring takes place when an ink droplet of a certain color impinges on a position adjacent to the position where an ink droplet of another color impinged previously.
Figure 10B:
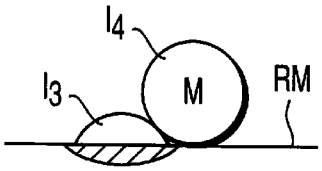

To be more specific, FIGS. 10A to 10E collectively show an ink permeation model, covering the case where a color bleeding takes place when a magenta ink droplet impinges on the adjacent position at the next timing after impingement of a yellow ink droplet on a certain position. FIG. 10A shows the state that a yellow ink droplet $I_3$ impinges on the recording medium RM, and FIG. 10B shows that a magenta ink droplet $I_4$ impinges on the recording medium RM at the next timing.

Figure 10C:
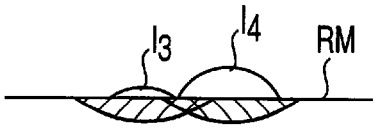
Figure 10D:
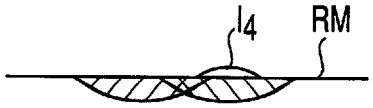
Figure 10E:
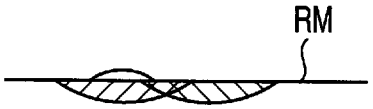

If the magenta ink droplet $I_4$ impinges on the recording medium before the yellow ink droplet $I_3$ permeates the recording medium RM completely, the yellow ink droplet $I_3$ and the magenta ink droplet $I_4$ are allowed to contact and are mixed with each other in a liquid state in the process of permeating the recording medium, as shown in FIG. 10C, so as to bring about a bleeding phenomenon as shown in FIGS. 10D and 10E and, thus, to deteriorate the print image. Incidentally, time is plotted on the abscissa, and the moving direction of the ink droplet is plotted on the ordinate in FIGS. 10A to 10E.

Figure 11A:
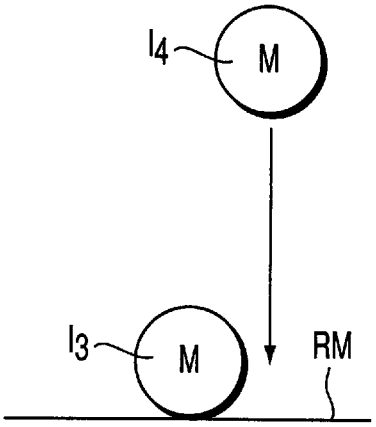
FIGS. 11A to 11E show the ink permeation model covering the case where an ink droplet of a certain color impinges on a position adjacent to the position where an ink droplet of another color impinged previously in the embodiment of the present invention.
Figure 11B:
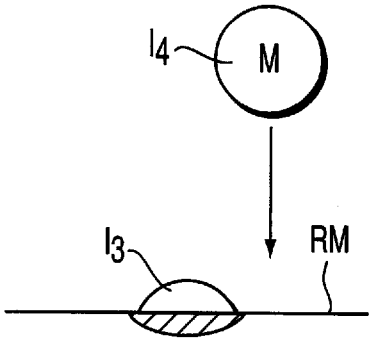
Figure 11C:
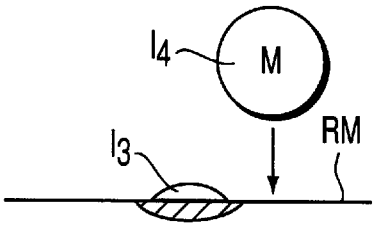
Figure 11D:
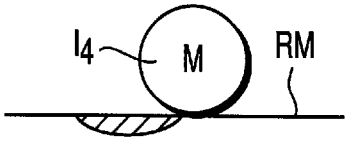
Figure 11E:
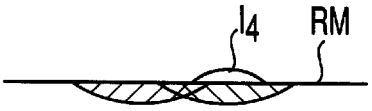

On the other hand, FIGS. 11A to 11E collectively show an ink permeation model covering the case where a bleeding does not take place. As in FIGS. 10A to 10E, time is plotted on the abscissa, and the moving direction of the ink droplet is plotted on the ordinate in FIGS. 11A to 11E. In the ink permeation model shown in FIGS. 11A to 11E, the magenta ink droplet $I_4$ is controlled to impinge on the adjacent dot position after the yellow ink droplet $I_3$ permeates the recording medium RM completely so as not to bring about a bleeding phenomenon. To be more specific, FIG. 11A shows the state that the yellow ink droplet $I_3$ impinges on the recording medium RM. When the magenta ink droplet $I_4$ impinges on the recording medium RM, the yellow ink droplet $I_3$ finishes permeation into the recording medium RM, as apparent from FIG. 11D showing the state that the magenta ink droplet $I_4$ impinges on the recording medium RM. As a result, the magenta ink droplet $I_4$ permeates the recording medium RM after completion of the permeation of the yellow ink droplet $I_3$ into the recording medium RM, as shown in FIG. 11E.

In order to achieve the state shown in FIGS. 11A to 11E, it is absolutely necessary in this case, too, to satisfy the condition of $T \leqq Tx$, where T represents the time required for the yellow ink droplet $I_3$ impinging on the recording medium RM to permeate completely the recording medium RM, and Tx represents the time interval between impingement of the yellow ink droplet $I_3$ on the recording medium RM and impingement of the magenta ink droplet $I_4$ on the recording medium RM.

As described above, where a first ink droplet impinges on a certain point on a recording medium and, then, a second ink droplet impinges on an adjacent point on the recording medium, the time T (ms) required for the ink droplet to be absorbed completely by the recording medium is:

$$T=(4V/\pi D^2 Ka)^2,$$

where V represents a maximum amount (ml) of the ink droplet ejected from the recording head in a single operation, D represents an average diameter (m) of an equivalent circle of the dot formed by the impingement of the ink droplet on the recording medium, and Ka represents an ink absorption coefficient ($ml/m^2 \cdot ms^{1/2}$) of the recording medium.

It follows that it is necessary to perform a color image recording by setting the conditions of T, V, D and Ka to meet the relationship $T \leqq Tx$, where Tx represents the time interval (ms) between impingement of a first ink droplet on a certain point of the recording medium and impingement of a second ink droplet on an adjacent point of the recording medium. Incidentally, T, V, D and Ka can be set under the same conditions in order to allow the inks of the different colors to exhibit the same properties as much as possible.

By setting the conditions of T, V, D and Ka to meet the relationship $T \leqq TX$, it is possible to prominently suppress deterioration of the image quality such as the thickening of the overlapping lines and the color-superposed characters. In addition, the fixing capability can be improved, and the ink cost can be saved. It should also be noted that measures for deriving the optimum conditions can be obtained from the optimum conditions for the resolution (dot diameter), the amount of the ink droplet, the printing speed, etc. for performing the printing and from the result of permeability when the ink permeates the recording medium, making it possible to save the time and labor required for obtaining the measures for deriving the optimum conditions. In other words, these conditions can be derived efficiently.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink jet recording method for recording an image on a recording medium by using an ink jet recording head, comprising the step of performing an image recording by setting time T (ms) required for an ink droplet ejected onto a recording medium to be absorbed completely by the recording medium, a maximum amount V (ml) of the ink droplet ejected from the recording head in a single operation, an average diameter D (m) of an equivalent circular area of the dot when the ink droplet impinges on the recording medium, and an ink absorption coefficient Ka ($ml/m^2 \cdot ms^{1/2}$) of the recording medium obtained by the Bristol method, said T, V, D and Ka having the relationship "$T=(4V/\pi D^2 Ka)^2$", to meet the condition of $T \leqq Tx$ (ms), Tx representing the time between a step for a first ink droplet to impinge on a certain position of the recording medium and another step for a second ink droplet to impinge on the same position of the recording medium.

2. An ink jet recording method according to claim 1, wherein the ink and the recording medium are used in combination to permit said absorption coefficient Ka to fall within a range of between 0.5 and 2.5 $ml/m^2 \cdot ms^{1/2}$.

3. An ink jet recording method for recording a color image on a recording medium by using an ink jet recording head, comprising the step of performing a color image recording by setting time T (ms) required for an ink droplet ejected onto a recording medium to be absorbed completely by the recording medium, a maximum amount V (ml) of the ink droplet ejected from the recording head in a single operation, an average diameter D (m) of an equivalent circular area of the dot when the ink droplet impinges on the recording medium, and an ink absorption coefficient Ka ($ml/m^{2 \cdot ms 1/2}$) of the recording medium obtained by the Bristol method, said T, V, D and Ka having the relationship "$T=(4V/\pi D^2 Ka)^2$", to meet the condition of $T \leqq Tx$ (ms), Tx representing the time between a step for a first ink droplet to impinge on a certain position of the recording medium and another step for a second ink droplet to impinge on an adjacent position of the recording medium.

4. An ink jet recording method according to claim 3, wherein the ink and the recording medium are used in combination to permit said absorption coefficient Ka to fall within a range of between 0.5 and 2.5 ($ml/m^2 \cdot ms^{1/2}$).

* * * * *